US006132309A

United States Patent [19]

Panelli et al.

[11] Patent Number: 6,132,309

[45] Date of Patent: Oct. 17, 2000

[54] MODULAR CLEAN ROOM PLENUM

[76] Inventors: Paul Giulo Panelli, 36109 Crystal Springs Dr., Newark, Calif. 94560; David Emmett Benson, 17960 SW. Outlook La., Beaverton, Oreg. 97007; Howard Lyle Gile, 4975 Bilford La., Lake Oswego, Oreg. 97035

[21] Appl. No.: 09/267,123

[22] Filed: Mar. 10, 1999

[51] Int. Cl.[7] ..... B01L 1/04

[52] U.S. Cl. ..... 454/187; 55/385.2; 55/484; 169/54; 454/228; 454/232; 454/234

[58] Field of Search ..... 55/385.2, 484; 454/187, 228, 230, 232, 233, 234, 236; 169/54, 37

[56] References Cited

U.S. PATENT DOCUMENTS

| | | | |
|---|---|---|---|
| 5,462,484 | 10/1995 | Jung et al. | 454/187 |
| 5,613,759 | 3/1997 | Ludwig et al. | 362/149 |

FOREIGN PATENT DOCUMENTS

| | | | |
|---|---|---|---|
| 3-263534 | 11/1991 | Japan | 454/187 |
| 3-271645 | 12/1991 | Japan | 454/187 |
| 4-306450 | 10/1992 | Japan | 454/187 |

*Primary Examiner*—Harold Joyce

*Attorney, Agent, or Firm*—Skjerven Morrill MacPherson LLP; David E. Steuber

[57] ABSTRACT

A modular clean room plenum includes a rectangular plenum body with an air barrier forming a top surface of the modular clean room plenum and a ceiling grid forming a bottom surface of the modular clean room plenum. The modular clean room plenums are attached to the primary support structure of a clean room building in whatever number and configuration is required by the clean room layout. By providing, in one modular component, the air barrier layer, the ceiling grid, the framework between the two layers, the fire sprinkler system, the air transfer ducts, the balancing dampers and all of the normal components of the ceiling grid, the cost and time required for construction can be significantly decreased.

29 Claims, 7 Drawing Sheets

MODULAR CLEAN ROOM PLENUM

BACKGROUND

1. Field of the Invention

This invention relates to the construction of air delivery systems in clean rooms and, more particularly, to a modular clean room plenum for semiconductor manufacturing, aerospace, pharmaceutical and medical clean rooms and other applications where large volumes of particulate free, temperature and humidity controlled vertical laminar airflow are required.

2. Description of Related Art

Clean room air delivery systems are generally designed to filter out dirt and dust particles of a very small size, correct the humidity and temperature of the air, and supply that air into the clean room in a laminar airflow pattern. The laminar airflow may be either vertically downward from the ceiling to the floor, horizontally from one side of the clean room space to the other, or horizontally across the clean room work surface, and then downward to the floor. The vertically downward airflow direction is the most common in the industry.

The volume of air delivery to the clean room ranges from approximately 30 cubic feet per minute to 120 cubic feet per minute per square foot of clean room floor space. This volume compares to 1.0 to 1.5 cubic feet per minute per square foot of floor space in a typical office building. Such clean room air delivery systems are often used in semiconductor manufacturing clean rooms, but have numerous applications where a particulate-free, temperature and humidity controlled environment is required.

The design and construction process for structures built as clean rooms is typically both lengthy and costly. FIG. 1 illustrates a conventional clean room and air barrier arrangement. Based on existing design principles, the normal sequence is to construct the building's foundations and shell 11, including an extensive primary support structure 13 spanning the width and length of the clean room area using a minimum of intermediate support columns 12. Primary support structure 13 may be constructed of steel trusses, steel space frames, or various types of concrete. A roofing system added to the top of the primary support structure 13 forms a primary air barrier 3 to contain air within the building.

Next, secondary support structure 37 is attached to and supported by the bottom of the primary support structure 13. Secondary support structure 37 will support a secondary air barrier 35 covering the entire clean room area. The purpose of secondary air barrier 35 is to separate the "conditioned" supply air from the "dirty" return air. The "conditioned" supply air becomes "dirty" as it passes through the clean room space 17 and picks up heat, humidity, and dirt particles from persons, products, and machinery in the clean room space 17. Depending upon the particular design of the clean room 17, the "conditioned" supply air may be above the secondary air barrier 35 with the "dirty" return air below the barrier 35, or the "dirty" return air may be above the secondary air barrier 35 and the "conditioned" supply air below.

Secondary air barrier 35 must be sufficiently strong to support the weight of workers who may have to enter the space above secondary air barrier 35 to conduct maintenance or modifications, and to support the entire underlying ceiling grid 39 and all of its components.

Following installation of the secondary air barrier 35, a tertiary support system 45 is installed on the underside of the secondary air barrier 35 to support the ceiling grid 39 and its components. The secondary support structure 37 may also be required to support an automated material handling system 63 (a means of distributing product throughout the clean room) or other production equipment. The supports for such a material handling system 63 must penetrate the secondary air barrier 35 and are a source of air leaks, as well as being difficult to construct. The ceiling grid 39 which forms the tertiary air barrier comprises a sealed structural support system that may contain, but is not limited to, air filters, return air grilles, blank panels, and lights. The ceiling grid 39 also provides support for the fire sprinkler system. A piping system is added to the assembled ceiling grid 39, a sprinkler main (not shown) is connected to the piping system, sprigs are installed, and sprinkler heads are connected to ceiling grid 39. Electrical wiring and light fixtures are also connected to the ceiling grid 39.

An exemplary ceiling grid 39 is described in U.S. Pat. No. 5,613,759 to Ludwig, Spradling, and Benson. As described in Ludwig et al., the ceiling grid 39 has a grid of interconnected rails in a rectangular pattern with openings between the rails generally 2'×4' in dimension. These rails have moat-like channels on each side, which form a continuous moat around all sides of the rectangular openings. All of the rectangular openings will be in-filled with, e.g., high efficiency particulate filters (filters may be of any type well known in the art, such as a HEPA or ULPA filters, similar to those manufactured by, e.g., Flanders or Filtra), blank panels, lights, sprinkler head panels, and return air grills. The items installed in the ceiling grid 39 have downwardly depending flanges around their peripheral edges that fit into the moat-like channels of the grid 39.

After each rectangular opening is filled, a gel sealant, e.g., BioMed 246 manufactured by Formula Brand Coatings & Products, is poured into the moat-like channels to seal the entire ceiling grid 39. This sealed ceiling grid 39 forms the tertiary air barrier. Alternatively, other forms of sealants can be used to seal the ceiling grid. In addition, other types of ceiling grids 39 use T-shaped interconnecting rails and filters, blank panels, lights, sprinkler head panels, and return air grills with flat bottoms rather than downwardly depending flanges. These various panels are sealed into the grid system 39 using various forms of gaskets to prevent air leakage. Before the installation of the gel-sealant into the channels of ceiling grid 39, the interior of building shell 11 must receive a thorough cleaning to remove dirt particles introduced into the space during construction.

After the ceiling grid 39 is installed, transfer air ducts 9 are installed extending from the secondary air barrier 35 to the ceiling grid 39. In most clean room installations, there is an array of transfer air ducts 9. However, for clarity, FIG. 1 illustrates only one transfer air duct 9. The transfer air ducts 9 may carry either "conditioned" supply air or "dirty" return air depending upon the air flow pattern of the design. If the "conditioned" supply air is above the secondary air barrier 35, transfer air ducts 9 with balancing dampers 91 and flex connections 31 are installed from the secondary air barrier 35 down to each of the filters in the ceiling grid 39. These transfer air ducts 9 will deliver "conditioned" supply air through the filters and into the clean room 17. In this case, "dirty" return air passes through the return air grilles directly into the "dirty" return air plenum 41 below the secondary air barrier 35. This embodiment is illustrated in FIG. 1.

If the "conditioned" supply air is located below the secondary air barrier 35, the "conditioned" supply air passes directly through the filters into the clean room space 17. The "dirty" return air must then be ducted from the return air grills 5 (FIG. 3) in the ceiling 39 up through the secondary air barrier 35 into the "dirty" return air plenum 41.

The "dirty" return air is taken through a recirculation air handling unit 21, returned as "conditioned" supply air and delivered through the filters to the clean room space 17. Recirculation air handling units 21 of this type are typically located outside the clean room space 17. Alternatively, "conditioned" supply air may be circulated through a fan unit (not shown) located above the ceiling grid 39 and below the secondary air barrier 35. These units are generally referred to as a fan filter units (FFU).

The operation of the arrangement shown in FIG. 1 is as follows. Recirculation air handler (RAH) unit 21 takes air from return air plenum 41 in the direction indicated by RAH inlet airflow arrow 27. The RAH unit 21 corrects the temperature and humidity of the air, and supplies it to air supply plenum 40 in the direction of conditioned supply arrow 15 at an increased air pressure. The supply air travels down through an array of transfer air ducts 9, dampers 91, and air filters 47, into clean room 17 in a laminar airflow pattern. The laminar airflow travels downward as indicated by arrow 29 towards raised floor 18. The air travels through raised floor 18 via air holes provided in the floor, passes through subfloor region 19 to return air chase 43, up through ceiling grid 39 in the direction of arrow 16 and back into return air plenum 41. In return air plenum 41, return air from the clean room 17 is mixed with air from outside the building, provided by makeup air unit 23.

Makeup air unit 23 takes outside air, adjusts it for interior temperature and humidity requirements, filters it, and supplies the air through ductwork 51 to return air plenum 41 along the path illustrated by MAU airflow arrow 25. The new air from makeup air unit 23 mixes with the return air from the clean room 17 and is processed by recirculation air handler 21 to be supplied back to clean room 17, as described above.

Design of the clean room 17 requires very specific and carefully controlled air velocities in a vertical airflow pattern. For the clean room 17 to be certified, the air velocity must be within certain limits of the design velocities, usually 5% to 10% of design. The air velocity can be set and controlled by adjusting balancing dampers 91 located in the air supply to each of the air filters 47 in the ceiling grid 39, and by adjusting the settings on the recirculation air handling unit 21. In clean rooms 17, the balancing dampers 91 may be located at the bottom end of the transfer air ducts 9 above the ceiling grid 39 and below the secondary air barrier 35.

Balancing typically requires a two-step process because the balancing damper 91 is in an inaccessible location when the ceiling grid 39 is completed. A preliminary balance is achieved by adjusting the balancing dampers 91 before the ceiling grid 39 is completed, followed by a final balance after completion of ceiling grid 39. This process is time-consuming and interferes with the construction process, and can lead to certification delays if the preliminary balance was not accurate. To correct an inaccurate damper balance, the ceiling grid 39 will have to be opened and the balancing damper 91 adjusted properly. If the airflow requirements of the clean room 17 change, it usually is necessary to shut down the manufacturing operation so the ceiling grid 39 may be opened and the balancing dampers 91 accessed.

Buildings housing clean rooms 17 typically require the construction to proceed in a set sequence. First the foundations are constructed, then the primary structural support 13, followed by the roofing system. With the roofing system complete, construction of the clean room air distribution system may begin. First, the secondary support system 37 is installed, followed in sequence by the secondary air barrier 35, the tertiary support system 45 and the ceiling grid system 39. The final stage of the construction is the installation of the transfer air ducts 9, the fire sprinkler system, the filters, blank panels, sprinkler head panels and return air grilles. Preliminary balancing of the dampers 91 must take place before the ceiling grid 39 is completed, followed by final balance after completion of the ceiling grid 39.

Construction of these systems is difficult and time-consuming due the necessity of working high above the clean room floor. This arrangement requires a means to lift the workers up to the construction level, or that workers stand on the steel truss sections, either of which increases costs, construction time, and the danger of injury from falls. In addition, much of the construction that takes place must be done in a manner such that the amount of contaminants brought into the clean room space 17 is held to a minimum. This requires that construction personnel practice clean room protocol, including cleaning tools and equipment before being brought into the clean room, wearing protective clothing, and executing the construction using pre-approved clean room techniques. The productivity level of all work conducted in clean room 17 is measurably lower than the same work conducted outside clean room 17.

Due to building code requirements, the space between the ceiling grid system 39 and the secondary air barrier 35 and the space between the secondary air barrier 35 and the roofing system must be protected from the effects of fire. Although the space above the secondary air barrier 35 is typically unoccupied, because it supports a major portion of the building, it therefore must be fire protected to meet safety codes. This fire protection is typically applied before the secondary air barrier 35 is installed. The clean room space 17 below the ceiling grid system 39 is generally considered by building codes to be an "occupied space", therefore requiring application of stricter fire protection rules. The return air plenum area is generally protected by fire sprinkler risers, called "sprigs", connected to the conventional fire sprinkler system serving the clean room space 17. These sprigs are usually installed after the ceiling grid system is in place and before the filters, blank panels, sprinkler head panels and return air grilles are installed.

In most clean room environments, the manufacturing process requires that the clean room space 17 be divided into separate and distinct zones, requiring a complete separation of the air streams from the primary air barrier 3 through the clean room subfloor 19 to avoid cross-contamination of the air between various processes. Also, many buildings are constructed larger than current manufacturing space requirements, and the "future growth" areas must be separated from the utilized clean room space. In both cases, the separation is typically achieved using vertical barriers, referred to as "demising walls".

Demising walls are typically connected to the building structural system for support, and are constructed similar to a standard wall, using sheet rock, sheet metal or special clean room panels for the wall surface. This type of vertical barrier is labor intensive to construct and difficult to move if the demands of the manufacturing process require a change. Using existing clean room construction techniques, adjustments to the demising walls will incur substantial costs and usually disturb the existing manufacturing process.

In the semiconductor manufacturing industry, the total construction time for a facility has significant cost ramifications. It is not uncommon for semiconductor fabrication clean rooms to output over a million dollars worth of products per hour. Accordingly, any decrease in construction time accelerates the schedule for producing wafers, which can generate substantial amounts of money. Thus, in addition to the overall need for cutting construction costs, there is a significant economic incentive for streamlining and shortening the construction process for semiconductor clean room facilities.

Accordingly, it is clear there is a need for an improved clean room plenum system design that lowers construction costs, decreases construction timelines, easily adapts to changing manufacturing space requirements, and can be constructed with increased safety. The plenum system based upon such a design should be easily modifiable with respect to area partitioning, clean room expansion, filter locations, blank panel locations, "dirty" air return locations, lighting locations and fire sprinkler layout. The plenum system should afford the ability to hang automatic material handling systems (AMHS) and other production equipment from the ceiling grid without having to penetrate the secondary air barrier to attach to the secondary support structure. The plenum system should reduce the time required to achieve the critical air balance requirements and make re-balancing relatively easy. The plenum system should also greatly reduce the hazards of working high above the clean room floor during installation and modification.

SUMMARY

In accordance with the present invention, a modular clean room plenum is provided. The modular clean room plenum includes the secondary air barrier, the transfer air ducts, the ceiling grid system, the balancing dampers, the lighting, the fire sprinkler system, and the framework between the secondary air barrier and the ceiling grid in one modular component manufactured in a plant remote from the construction site. The rectangular modular clean room plenum is made up of a top surface forming the secondary air barrier, a bottom surface forming the ceiling grid system, and sides supporting the top and bottom surfaces. The modular clean room plenums are attached to the primary structural support system in whatever number and configuration are required by the clean room layout. The secondary support system and tertiary support system are eliminated or minimized because the modular clean room plenum is designed to be self-supporting from the primary support system.

The modular clean room plenum also includes support for automatic material handling systems, fan filter units, and other equipment required by the manufacturing process. Using the modular clean room plenum of the present invention, the air barrier and the ceiling layer are lifted into place simultaneously. Thus, the cost and time required for construction at the project site is significantly decreased because much of the high work required by current design principles is eliminated.

In addition, while clean rooms constructed using current design principles must be built in place after the building's primary structural support system and roofing system are installed, the modular clean room plenums can be assembled away from the construction site in another manufacturing facility. The modules can be constructed in parallel with the construction of the building's primary support system and roofing system. The modules can then be shipped to the site for installation as soon as the roofing system is completed. Because the modules are constructed outside the clean room where clean room protocol is not required, the efficiency is increased and costs decreased.

One embodiment of the present invention includes a balancing damper attached to the bottom of the transfer air duct inside the modular clean room plenum body. Another embodiment of the present invention includes a balancing damper attached to the top of the transfer air duct and located on top of the modular clean room plenum body.

The modular plenum in accordance with the present invention also provides a modular sprinkler system comprising a distribution pipe, vertical sprigs, and sprinkler heads attached by flexible hoses.

The modular clean room plenum in accordance with the present invention may also include a modular electrical system having electrical wiring and at least two junction boxes connected to the electrical wiring for connection with junction boxes of adjacent plenum bodies. This modifiable electrical system provides electricity to each plenum body and lighting in any required configuration. It also provides the ability to incorporate controls and variable speed drives for FFU's, AMHS and other equipment required by the manufacturing process.

The modular clean room plenum system provides a base for constructing adaptable demising walls for smoke control, manufacturing zone separation or future build-out limits. This demising wall is constructed in such a way that future expansion of the clean room space is accomplished by attaching additional modules to the existing modules with the demising wall still in place. When construction of the additional space is complete, the demising wall can easily be moved to the new manufacturing zone limits.

In accordance with the present invention, a method for installing a clean room plenum is taught, comprising the steps of assembling modular plenum bodies, installing a primary support structure in a building, and attaching the plenum bodies to the primary support structure.

BRIEF DESCRIPTION OF THE DRAWINGS

Use of the same reference symbols in different figures indicates similar or identical items.

DETAILED DESCRIPTION OF THE PREFERRED EMBODIMENTS

Figure 1:
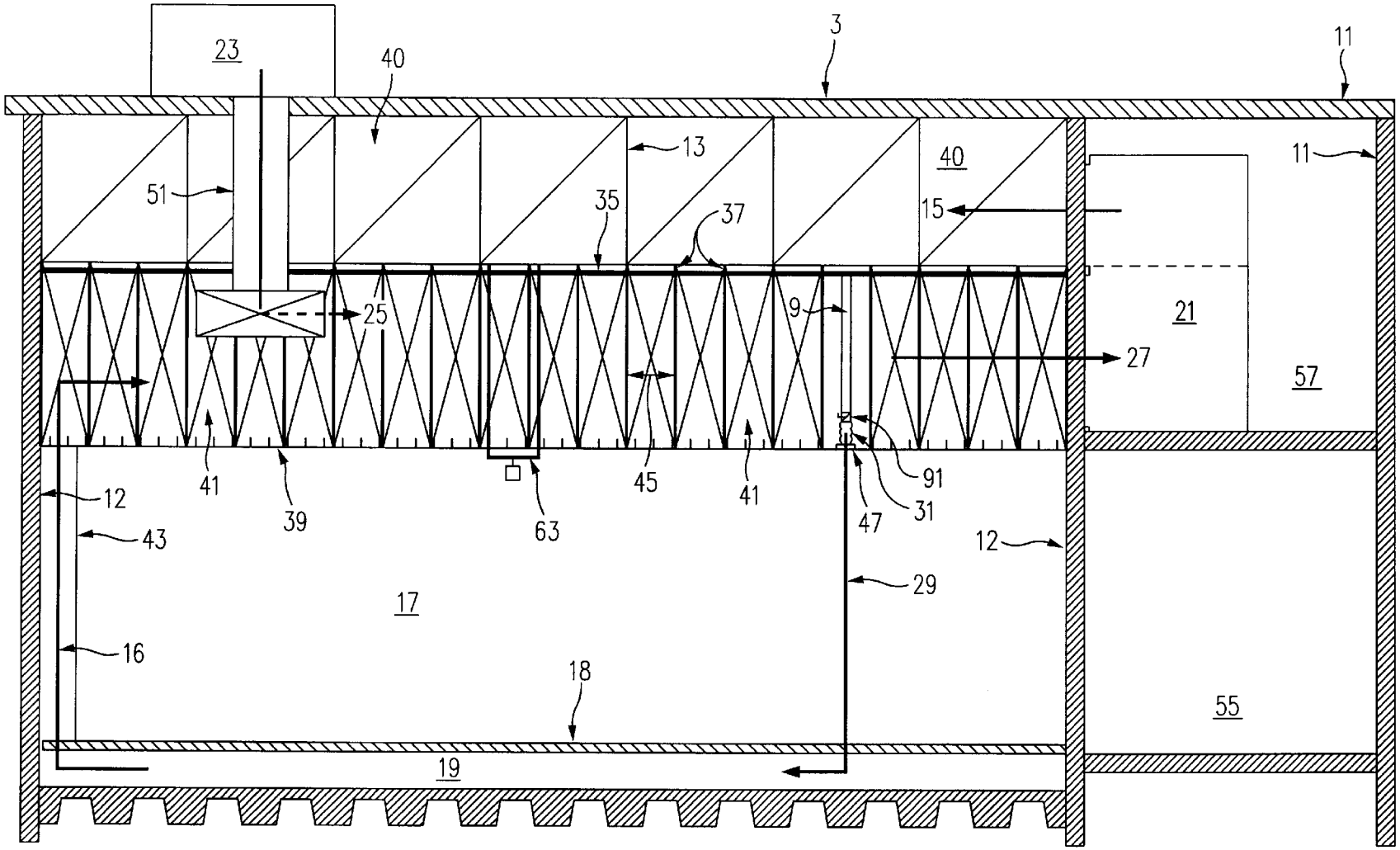
FIG. 1 (PRIOR ART)
FIG. 1 illustrates a prior art clean room construction.
Figure 2:
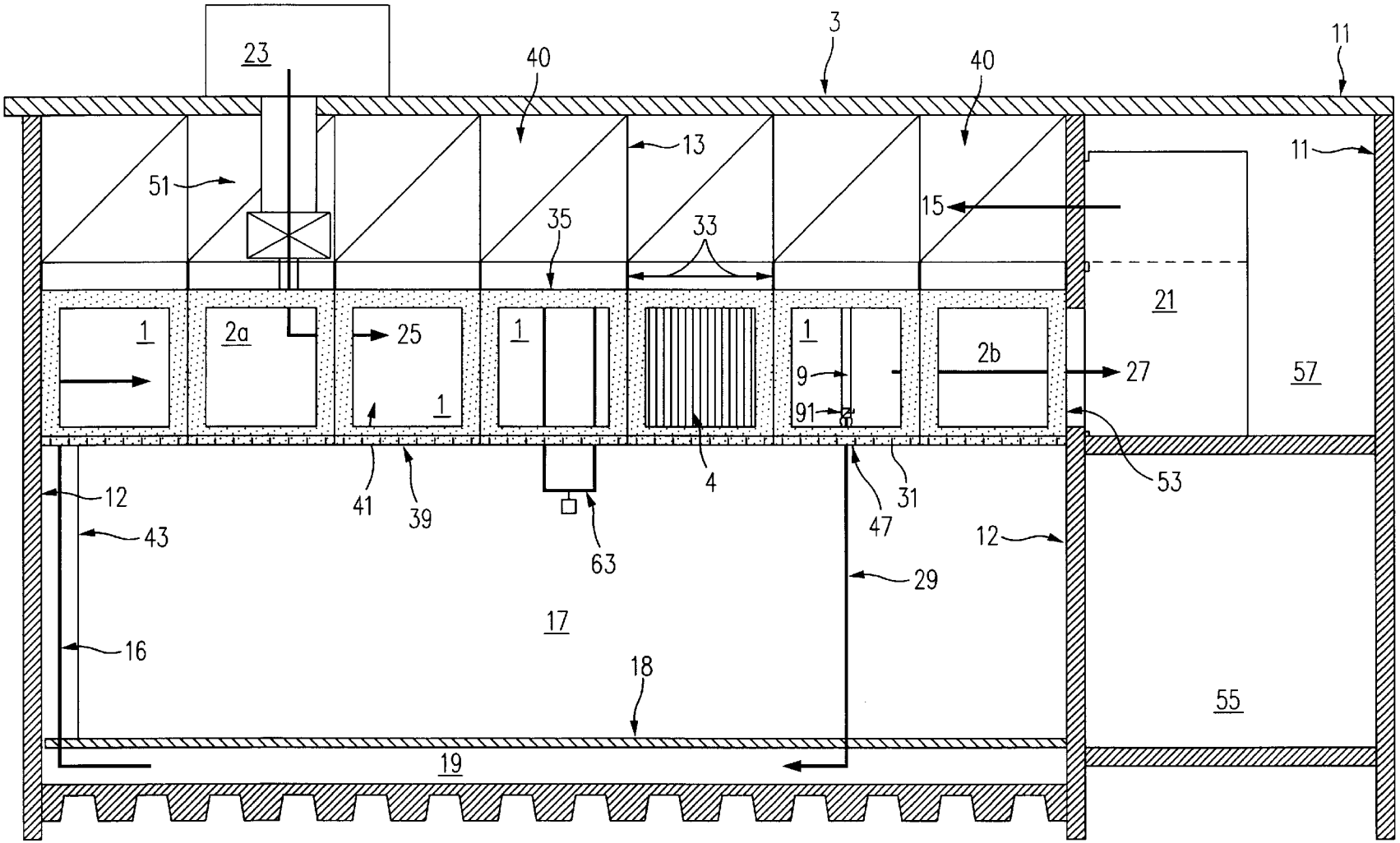
FIG. 2 illustrates clean room construction using the modular clean room plenum arrangement of the present invention.

FIG. 2 illustrates a clean room 17 using the modular clean room plenum arrangement of the present invention. Building shell 11, primary support structure 13, support columns 12, and primary air barrier 3 are constructed essentially as described above with respect to FIG. 1. However, the remaining structural features, comprising secondary air barrier 35 through to the tertiary air barrier are constructed as a collection of modular clean room plenums 1. Each individual modular clean room plenum 1 provides in one preassembled unit the secondary air barrier 35, secondary support system 37, tertiary support system, transfer air ducts 9, balancing dampers 91, sprinkler main 73, sprinkler heads 83, sprigs 87, ceiling grid 39, and a lighting system. A plurality of modular clean room plenums 1 are attached to the primary support structure 13 and connected to each other to form a negative pressure plenum and complete construction of the clean room facility.

Figure 3:
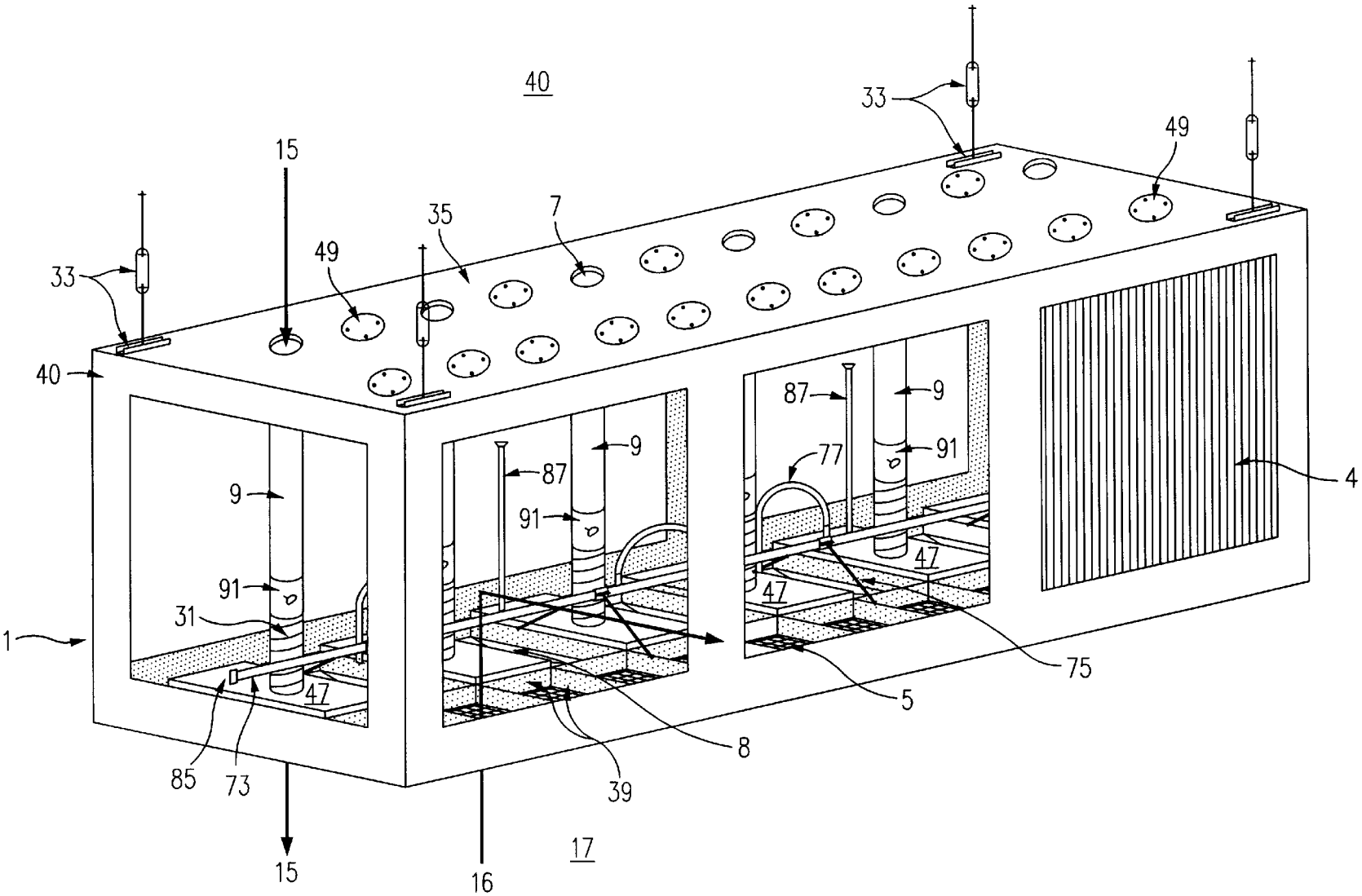
FIG. 3 illustrates a three-dimensional view of a modular clean room plenum in accordance with the present invention.

FIG. 3 illustrates a three-dimensional view of a modular clean room plenum 1 in accordance with the present invention. The top and bottom surfaces and sides of modular clean room plenum 1 are substantially rectangular-shaped with the top surface forming secondary air barrier 35 and the bottom surface forming the ceiling grid 39 and the tertiary air barrier. The top of each modular clean room plenum 1 includes a plurality of openings 7 designed to receive transfer air ducts 9. Each opening 7 is centered over one of the rectangular openings in the ceiling grid 39 below. Transfer air ducts 9 are inserted into all openings 7 that are above air filters 47. The number and placement of air filters 47 are determined by the layout of the manufacturing equipment in the clean room. Each opening 7 not containing a transfer air duct 9 is provided with a cover plate 49 to protect workers from stepping through an uncovered opening 7 and to prevent unwanted air flow through secondary air barrier 35. Openings in ceiling grid 39 contain either air filters 47 or blank panels 8 over the clean room area, and return air grills 5 over the return air chase 43.

Modular clean room plenum 1 is attached to primary support system 13 using support connections 33. The embodiment shown in FIG. 3 includes four support connections 33 located at the top four corners of the modular clean room plenum 1. Alternatively, different numbers of support connections 33 (e.g., eight connections) or any other mounting system methods may be used to securely mount the modular clean room plenum 1 to the primary support system 13.

The airflow through the installed modular clean room plenums 1 is as follows. Conditioned supply air flows from supply air plenum 40 into transfer air duct 9, through balancing damper 91, duct flex connector 31 and air filter 47, and into clean room 17 below. "Dirty" return air flows up from the return air chase 43 through return air grill 5 into return air plenum 41, and back toward recirculation air handling unit 21.

While modular clean room plenum 1 may be constructed in any size, some factors which would be considered in determining the dimensions of the modular clean room plenum 1 are the building structure, area, and airflow requirements. For example, in a building constructed with support columns spaced at 24 feet, the modular clean room plenum 1 shown in FIG. 3 may be constructed 24 feet long and 8 feet wide. The height of the modular clean room plenum 1 will be affected by various factors, including the amount of return airflow required for recirculation air handler 21 and the height of clean room 17 within the building shell 11. It is understood that the invention is not limited by any specific dimensions of the modular clean room plenum 1.

Figure 4:
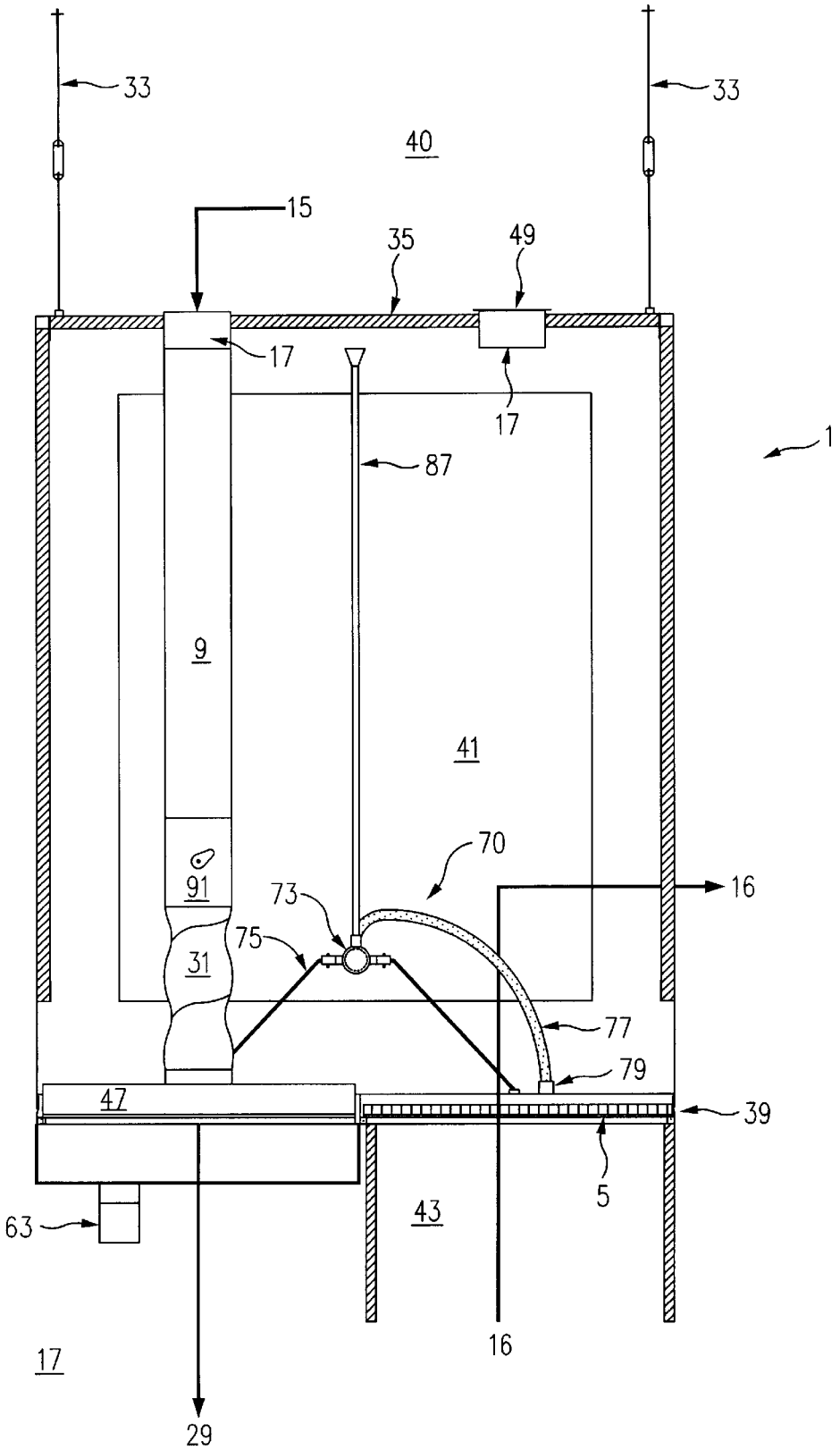
FIG. 4 illustrates a cross-sectional view of a modular clean room plenum in accordance with the present invention.
Figure 7:
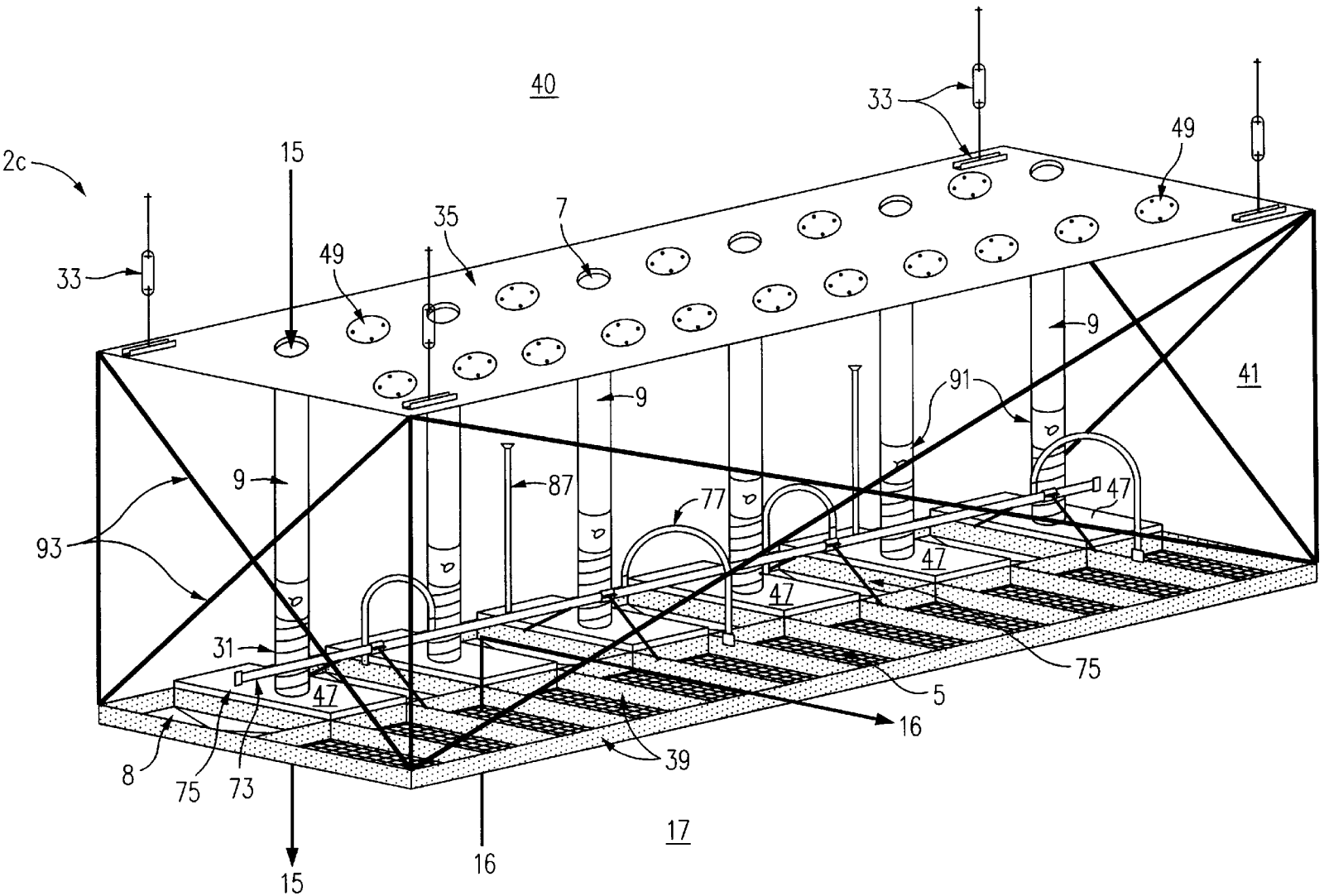
FIG. 7 illustrates another embodiment of the present invention incorporating cross-bracing.

FIG. 4 illustrates a cross-sectional view of the modular clean room plenum 1. In this embodiment, balancing dampers 91 are located inside return air plenum 41 towards the bottom of transfer air ducts 9. The dampers 91 shown in FIG. 7 are adjusted from below the clean room ceiling after the air filters are installed but before the blank panels are installed.

In another embodiment, dampers 91 are attached to the top of opening 7 on the top of the modular clean room plenum 1. When balancing dampers 91 are located on top of the modular clean room plenum 1, workers must enter the "clean" air region of the supply air plenum 40 in order to make adjustments to dampers 91. Because this may interfere with the proper operation of the clean room system, the system is generally shut down when such adjustments are performed. The placement of the dampers 91 inside the "dirty" air region of return air plenum region 41, as shown in FIG. 4, allows adjustment to the airflow through transfer air duct 9 and air filter 47 without interruption of the operation of the clean room.

Also shown in FIG. 4 is an embodiment of modular sprinkler system 70 which includes sprinkler main 73 that runs lengthwise through the modular clean room plenum 1 and is supported by supports 75. At each end of sprinkler main 73 is a terminal 85 (FIG. 3) that can either be capped or be connected with a terminal 85 of an adjacently mounted modular clean room plenum 1. This simplifies the process of providing water to all adjacent modular clean room plenums 1.

Emerging from sprinkler main 73 at periodic points are flex hoses 77. Flex hoses 77 may be made of a stainless steel flex and can be connected to any of a number of flex hose mounts 79 provided in ceiling grid 39. These mounts can be provided in a regular pattern across the ceiling grid 39. On the opposite side of the flex hose mounts 79, sprinkler heads (not shown) can be attached according to the sprinkler coverage requirements of the clean room floor. With this system, sprinkler heads can be provided in multiple configurations and can easily be modified as required by changing clean room layouts by simply moving the sprinkler heads to a new location and coupling a flex hose 77 to the appropriate flex hose mount 79.

The sprigs 87 in the modular clean room plenum 1 serve the space between the secondary air barrier 35 and the ceiling grid 39, and the sprinkler heads on flexible hoses serve the clean room space 17 below the ceiling grid 39. Unlike current systems wherein the sprigs 87 must be installed after the ceiling grid is in place, the modular clean room plenum's sprigs 87 are installed at the off-site manufacturing facility and are already in place when the module arrives at the job site.

As shown in FIG. 4, modular clean room plenum 1 may also provide supports for an automatic material handling system 63. In this embodiment, ceiling grid system 39 is adapted for connection with tracks or rails, as required by an automatic material handling system 63, as is known in the art. Unlike prior art systems which require that the automatic material handling system 63 be supported by the secondary support system 37, the modular clean room plenum 1 provides sufficient support for the automatic material handling system 63. By providing the connections for an automatic material handling system 63 in advance, fewer connections between support structures are required, thereby increasing efficiency and achieving improved air flow sealing.

The modular clean room plenum 1 can also include a modular electrical system to provide electricity for light fixtures on the clean room ceiling. With such an electrical system, electrical wiring can be integrated into the ceiling grid 39 during assembly off-site, eliminating the extra wiring step necessitated by prior art assembly processes. The electrical wiring may include junction boxes at two or more sides of the modular clean room plenum 1 for connection with junction boxes of adjacent modular clean room plenums 1, and also provides connections for light fixtures to be mounted to the bottom of ceiling grid 39. This allows electric power and lighting to be provided across the entire plenum quickly and easily. Like sprinkler heads 83, the electrical connections may be provided at multiple points across the ceiling grid 39, thereby allowing for later changes in the light fixture placement.

Wiring for computer network connections may also be provided in a similar fashion as the electrical wiring. The network wiring may be bundled with the electrical wiring, or may be provided separately.

A number of advantages are achieved by using a modular clean room plenum 1 in accordance with the present invention.

First, a significant reduction in construction time is achieved. Presently, there are generally two phases of construction for clean room sites: first, the building shell 11 including primary support system 13 is installed; and second, the balance of the system from the secondary support system 37 through ceiling grid 39 is installed. Each of these two phases of construction requires approximately 45 days to complete in a typical 100,000 square foot clean room building area.

Using the present invention, all of the components of the modular clean room plenum 1 as described above are manufactured and assembled off-site, then delivered to the construction site as needed. Thus, after the first phase of construction is complete, premanufactured modular clean room plenums 1 are quickly and easily installed by simply lifting each preassembled modular clean room plenum 1 up to primary support structure 13 using a conventional lift device, and attaching the plenum 1 to the support structure 13. Because the modular clean room plenum 1 can be manufactured off-site and in parallel with the first phase of construction, the present invention reduces the time required for the second phase of construction from, e.g., 45 days in the example given above to 10 days.

Another advantage of the off-site manufacturing of the modular clean room plenum 1 is that cleanliness can be more easily controlled than at the construction site, thereby reducing the amount of time required to clean the area before gel is installed in the ceiling grid. Modular clean room plenum 1 may be constructed of powder-coated steel rather than rough steel to further assist in maintaining a clean installation.

The modular clean room plenum system can also improve the process of installing the filters in the ceiling grid 39. In the past, the secondary support structure 37 and ceiling grid 39 must be in place before the gel sealant could be poured into the ceiling grid vessels. With the modular clean room plenum system, the gel sealant, air filters, blank panels, and other ceiling grid elements can be installed in ceiling grid 39 while the modular clean room plenum 1 is resting on the clean room floor. Because this step is completed on the floor, rather than high up in the air, the work can be conducted with increased ease and safety over construction techniques used for the current design principles.

Because the modular clean room plenum 1 is constructed with enough internal structural rigidity to safely hold its own weight, most of the secondary support system 37 used in the prior art to support the weight of the plenum structure is unnecessary when using the present invention, resulting in savings in cost of materials and construction time.

The modular clean room plenum 1 also provides superior installation of demising walls. The modular clean room plenum 1 in accordance with the present invention may be open on each of its four sides to allow for airflow in any direction. Pre-shaped demising panels 4 constructed of powder-coated steel may be attached to any opening on any side of each modular clean room plenum 1 to prevent the flow of air through those openings of the modular clean room plenum 1, thus enabling control of the direction of air flow. Because these openings are consistently sized on all modules, the demising plates can be moved to any opening in any module.

These demising panels 2 can be installed either before the modular clean room plenum 1 is connected to the primary support structure 13, or at any later time when the manufacturing requirements change.

The modular clean room plenum 1 can be used to easily expand the manufacturing area. In a building shell 11 that is only partially used, the edge of the clean room floor space may be sealed by a wall which extends up to the bottom of the modular clean room plenum 1 and another wall which extends from the top of the modular clean room plenum 1 up to primary air barrier 3. The module top forms a walkable surface for persons to work on while erecting the upper wall. The side of the modular clean room plenum 1 aligning with the edge of the clean room floor space is sealed using demising panels 4 as described above. In this fashion demising walls may be easily built following the outline of the modular clean room plenum 1 in any pattern that suits the needs of the manufacturing process.

When additional clean room space is required on the manufacturing floor, any number of additional modular clean room plenums 1 can be installed over the required expansion area. The demising panels 4 along the side adjacent to these newly installed modular clean room plenums 1 are removed, and additional demising panels 4 are added to the new modular clean room plenums 1 to complete the air seal. With the primary support structure 13 already in place, this additional construction requires only minimal cost and time.

In addition to the generic modular clean room plenum 1 shown in FIG. 2, specialized plenum bodies may be constructed for installation in specific areas of the manufacturing floor.

Figure 5:
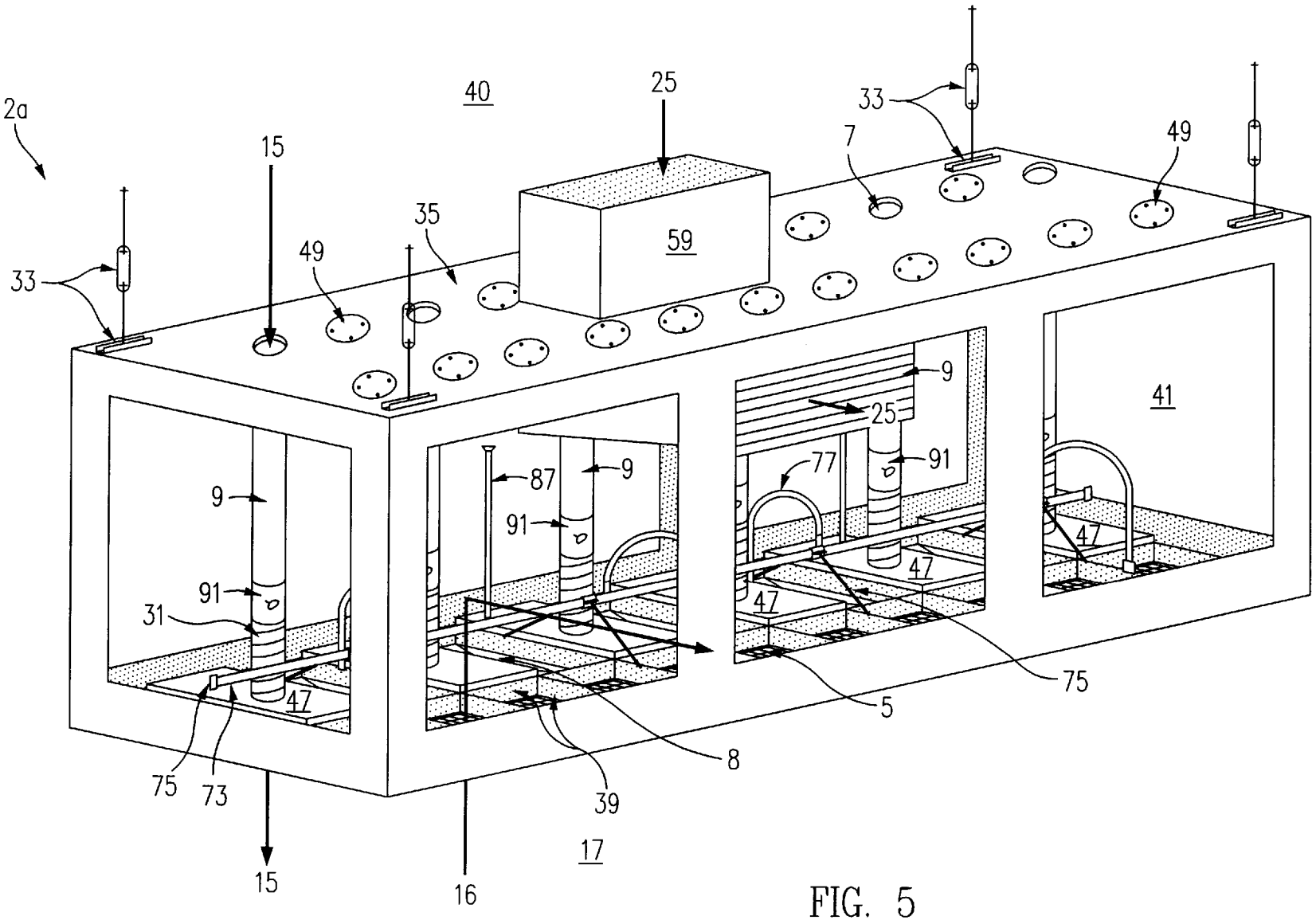
FIG. 5 illustrates a three-dimensional view of a modular clean room plenum used as a makeup air handling unit interface module in accordance with the present invention.

FIG. 5 shows another embodiment of a modular clean room plenum used as makeup air unit (MAU) interface module 2*a*, which is installed directly beneath makeup air unit 23. FIG. 2 shows an exemplary location of this module 2*a*, but other embodiments may include different locations of makeup air unit 23 and makeup air unit interface module 2*a*. MAU interface module 2*a* is similar to the modular clean room plenum 1 described above, but is adapted for connection with a modular air unit 23. Air enters return air plenum 41 of makeup air module 2*a* from makeup air unit 23 via makeup air unit ductwork 59. This airflow is shown by MAU airflow arrows 25.

Figure 6:
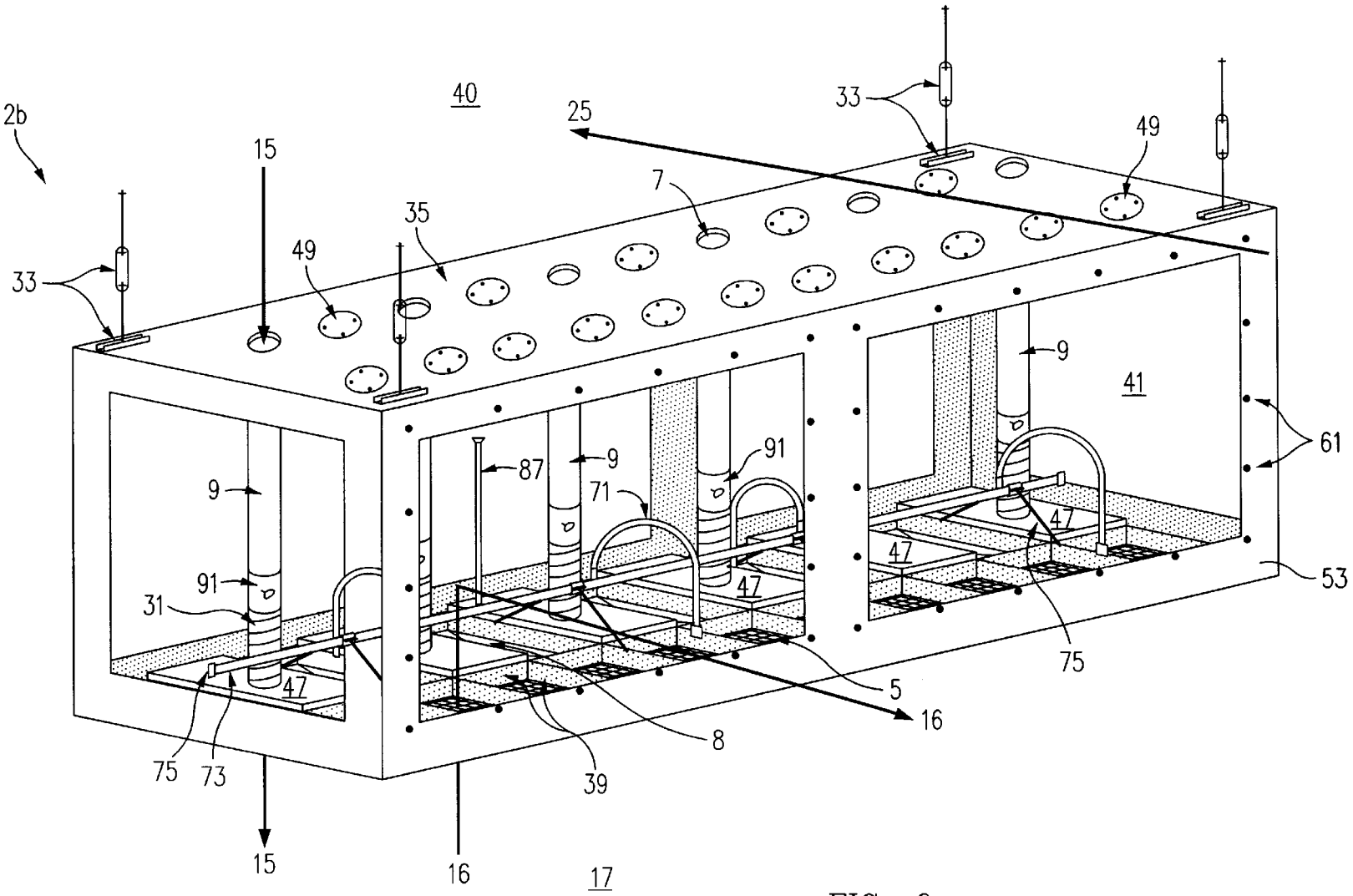
FIG. 6 illustrates a three-dimensional view of a modular clean room plenum used as a recirculation air handling unit interface module in accordance with the present invention.

FIG. 6 shows a modular clean room plenum used as a recirculation air handling unit (RAU) interface module 2*b*, which is installed adjacent to recirculation air handling unit (RAU) 21. FIG. 2 shows an exemplary location of this module 2*b*. The recirculation air handling unit interface module 2*b* includes an interface side 53, which includes connection holes 61 used to attach interface side 53 to recirculating air handling unit 21. Air flows in the direction of arrow 16, into recirculation air handling unit 23 and back into supply air plenum 40 in the direction of MAU airflow arrow 25. If vane axial fans or fan filter units are used to circulate the air in place of the RAU 21, this RAU interface module 2*b* may not be necessary. Makeup air unit 23 and recirculation air handling unit 21 are well known in the art and can, for example, be of the type manufactured by HUNTAIR of Tigard, Oreg.

One embodiment of this invention uses vane axial fans rather than recirculation air handling units to circulate the air. In that instance, the laminar airflow from the air ducts 9 passes through raised floor 18 and subfloor 19 into an area below subfloor 19 generally called the subfab (not shown). From the subfab, the "dirty" return air enters ductwork (not shown) and the vane axial fan (not shown) and is returned as conditioned supply air 15 in supply air plenum 40. The vane axial fans may be located in fan deck 57, in the subfab, or adjacent to corridor 55.

Another embodiment of this invention uses fan filter units (FFUs) to circulate the air. FFUs (not shown) may be located inside modular clean room plenum 1 in return air plenum 41, or on top of modular clean room plenum 1 in supply air plenum 40, and are supported by modular clean room plenum 1.

Alternatively, the FFU may be supported from the bottom surface of the modular clean room plenum 1, and, if necessary, support rods may extended from the top surface of the modular clean room plenum 1 to the secondary support system. This method of support eliminates the need to penetrate the secondary air barrier with support members and therefore eliminates the possibility of air leaks inherent with current design principles.

In many applications, additional air handling capacity is required at specific locations in the clean room. Current design principles deal with these as additions to the structural requirements for the air barrier. If the additional requirement comes about after the clean room is in operation, extensive revisions are required to the structural system to support the air handling equipment. The present invention provides adequate support for added air handling capacity at any location within the modular clean room plenum 1.

FIG. 7 shows another embodiment of the invention in which diagonal braces 93 are used to provide an additional structure for vertical and seismic support for the modular clean room plenum. All other elements of diagonal braced modular clean room plenum 2*c* may be similar to modular clean room plenum 1 described in FIG. 3 above.

Although the invention has been described with reference to particular embodiments, the description is only an example of the invention's application and should not be taken as a limitation. In particular, even though much of the preceding discussion was aimed at semiconductor clean room plenums, alternative embodiments of this invention are possible. Various other adaptations and combinations of features of the embodiments disclosed are within the scope of the invention as defined by the following claims.

We claim:

1. A modular plenum body, comprising:

an air barrier layer forming a top surface of the modular plenum body;

a ceiling grid forming a bottom surface of the modular plenum body;

four sides connecting the top surface and the bottom surface of the modular plenum body; and a transfer air duct vertically arranged in the modular plenum body for conducting air through the modular plenum body, the transfer air duct having a top end and a bottom end;

said plenum body being adapted for connection with a primary support structure in a building.

2. The modular plenum body of claim 1, wherein each of said four sides include airflow openings.

3. The modular plenum body of claim 1, further comprising a plurality of air filters positioned inside the ceiling grid.

4. The modular plenum body of claim 1, further comprising a plurality of transfer air ducts.

5. The modular plenum body of claim 1, further comprising a sprinkler system disposed within said modular plenum body, said sprinkler system comprising:

a sprinkler main;

a flex hose having two ends, a first end connected to the sprinkler main and a second end adapted to be removably connected to a sprinkler head provided on said ceiling grid.

6. The modular plenum body of claim 5, wherein the sprinkler main has at least two ends, each end being adapted to be connected to one of either a sprinkler main of an adjacent modular plenum body, a water source, or a cap.

7. The modular plenum body of claim 5, further comprising a sprinkler head disposed in the ceiling grid, the sprinkler head being removably connected to the second end of a flex hose.

8. The modular plenum body of claim 5, wherein the ceiling grid defines a series of pre-formed holes adapted to receive a sprinkler head.

9. The modular plenum body of claim 5, further comprising a sprig connected to the sprinkler main.

10. The modular plenum body of claim 9, wherein said sprig is a vertically-oriented pipe for the passage of water into an interior of the modular plenum body.

11. The modular plenum body of claim 1, further comprising an electrical system having electrical wiring and at least two junction boxes connected to the electrical wiring for connection with an adjacent junction box.

12. The modular plenum body of claim 1, further comprising four connections for connecting the modular plenum body to a primary support structure in a building.

13. The modular plenum body of claim 12, wherein said four connections are provided at four corners of the top surface of the modular plenum body.

14. The modular plenum body of claim 1, further comprising a balancing damper provided towards the top end of the transfer air duct.

15. The modular plenum body of claim 1, further comprising a balancing damper provided towards the bottom end of the transfer air duct.

16. The modular plenum body of claim 1, further comprising at least one demising panel removably attached to at least one side of the modular plenum body, thereby forming a substantially airtight seal on that side of the modular plenum body.

17. The modular plenum body of claim 1, wherein the top surface of the modular plenum body defines an opening for connection with a makeup air unit.

18. The modular plenum body of claim 1, wherein one side of the modular plenum body defines an opening for connection with a recirculating air unit.

19. A method for installing a clean room plenum, comprising the steps of:

assembling a modular plenum body, said modular plenum body being substantially rectangular with an air barrier layer forming a top surface of the modular plenum body and a ceiling grid forming a bottom surface of the modular plenum body;

installing a transfer air duct vertically arranged in said modular plenum body;

installing a primary support structure in a building; and attaching the modular plenum body to the primary support structure.

20. The method of claim 19, wherein the step of attaching the modular plenum body to the primary support structure comprises attaching a plurality of modular plenum bodies.

21. The method of claim 19, wherein each of the modular plenum bodies further comprises a plurality of transfer air ducts.

22. The method of claim 19, further comprising the step of installing air filters in the ceiling grid prior to the step of attaching the modular plenum body to the primary support structure.

23. The method of claim 20, further comprising:

providing said modular plenum body with a sprinkler main having at least two ends and a flex hose having a first end connected to the sprinkler main; and attaching an end of a first sprinkler main in a first modular plenum body to an end of a second sprinkler main in an adjacent modular plenum body.

24. The method of claim 23, further comprising the steps of:

installing a sprinkler head in the ceiling grid in the modular plenum body; and connecting a second end of the flex hose to the sprinkler head.

25. The method of claim 20, further comprising forming a series of connectors adapted to receive a sprinkler head in the ceiling grid of the modular plenum body, prior to the step of attaching the modular plenum body to the primary support structure.

26. The method of claim 20, wherein each of the modular plenum bodies further comprises electrical wiring and at least two junction boxes connected to the electrical wiring; and the method further comprises attaching a junction box in a modular plenum body to an adjacent junction box.

27. The method of claim 19, further comprising the step of:

attaching a demising panel to a side of a modular plenum body, thereby forming a substantially airtight seal on that side of the modular plenum body.

28. The method of claim 19, wherein said attaching the modular plenum body to the primary support structure comprises attaching four connection points provided on the top surface of the modular plenum body to the primary support structure.

29. A clean room, comprising:

a ceiling portion;

a primary support structure beneath the ceiling portion; and a plurality of modular plenum bodies connected to the primary support structure, each modular plenum body having an air barrier layer forming a top surface of the modular plenum body, a ceiling grid forming a bottom surface of the modular plenum body, four sides connecting the top surface and the bottom surface of the modular plenum body, and a transfer air duct vertically arranged in each modular plenum body, each transfer air duct having a top end and a bottom end.

* * * * *

UNITED STATES PATENT AND TRADEMARK OFFICE
CERTIFICATE OF CORRECTION

PATENT NO. : 6,132,309
ISSUE DATE : October 17, 2000
INVENTOR(S) : Benson, David E.; Gile, Howard L.; Panelli, Paul G.

It is certified that error appears in the above-identified patent and that said Letters Patent is hereby corrected as shown below:

The first-named inventor's name is corrected to read: Paul Giulio Panelli

Signed and Sealed this

Twenty-second Day of May, 2001

*Attest:*

Nicholas P. Godici

NICHOLAS P. GODICI

*Attesting Officer*

*Acting Director of the United States Patent and Trademark Office*